United States Patent [19]

Foster

[11] Patent Number: 5,018,355

[45] Date of Patent: May 28, 1991

[54] METHOD AND APPARATUS FOR PERIODIC CHEMICAL CLEANINGS OF TURBINES

[76] Inventor: Charles D. Foster, Rte. 4, Box 70G, Keyser, W. Va. 26726

[21] Appl. No.: 398,910

[22] Filed: Aug. 28, 1989

[51] Int. Cl.[5] ..... F01K 21/00

[52] U.S. Cl. ..... 60/646; 60/657

[58] Field of Search ..... 60/646, 657

[56] References Cited

U.S. PATENT DOCUMENTS 4,386,498 6/1983 Lee et al. ..... 60/657 X

FOREIGN PATENT DOCUMENTS 54-142406 11/1979 Japan ..... 60/646

*Primary Examiner*—Allen M. Ostrager

*Attorney, Agent, or Firm*—Cushman, Darby & Cushman

[57] ABSTRACT

The present invention relates to apparatus and a method for using that apparatus for replacing an existing governor valve on a steam chest of a high pressure turbine that enables chemical foam to be input from outside the turbine for cleaning chemical deposits from the turbine. This device enables chemical foam to be input without penetrating the turbine's main steam loop. When the cleaning process has been finished, the original governor valve can be easily replaced in a short period of time. The apparatus includes an inlet for the chemical foam, a structure for attaching the apparatus to the steam chest of the turbine, and a structure which allows the foam to flow from the steam chest to the turbine.

7 Claims, 2 Drawing Sheets

METHOD AND APPARATUS FOR PERIODIC CHEMICAL CLEANINGS OF TURBINES

FIELD OF THE INVENTION

This invention relates to a method and apparatus for permitting periodic introduction of cleaning agents such as a chemical foam into a steam turbine to remove deposits without altering the turbine system or mechanisms. More specifically, this invention relates to apparatus that can be attached to the steam chest of a turbine and through which cleaning agents can be directly fed to all portions of a turbine for cleaning purposes, and the method for attaching and using this apparatus.

BACKGROUND OF THE INVENTION

As the demand for electricity in today's society continues to grow, it is desirable to produce power as efficiently as possible. Use of steam to produce power through turbines is being increasingly expanded, both by greater numbers of turbines and by longer hours of operation. These increasing demands make it necessary for such turbines to be used in the most cost and energy efficient manners possible.

Older turbines are often refurbished with newer components to improve efficiency. Such components can include items such as nozzle blocks and reaction blading and will, because of improved manufacturing techniques and use of harder materials, often result in obtaining closer tolerances. This is also true in newer turbines. Thus, there is less flow area and since the harder materials do not erode as rapidly as did old steam path materials, keeping the flow path itself clean becomes essential in order to maintain efficient operation. The increasing size of the flow path area due to erosion that was characteristic of the old materials would in some cases, compensate for the deposit of buildup material and for a while allow an adequate steam flow passage to be maintained. This is not always the case with newer designs.

Accordingly, the closer tolerances and harder materials in conjunction with the improved operating performance resulted in conditions more sensitive to deposit buildup and require more frequent and better cleaning.

When materials do build up inside the turbine, it is important remove them as quickly as possible. One approach often used is to tear the high pressure (HP) turbine apart and blast the deposits off the internal parts with a grit or sand medium. This method involves high cost and a long period of down time during which the turbine cannot be used. In 1984, the cost of operating a HP turbine with efficiency and load curtailment was estimated to be $1.036 million annually and the cost of grit blasting was estimated at $350 thousand.

Another more cost effective method for removing deposits is to chemically clean the turbine and its internal parts. This method has been successfully performed by utility companies to combat load losses caused by chemical deposits in the steam paths of turbines.

However, to perform a chemical cleaning of a HP turbine, chemical cleaning agents, such as cleaning foams, must be injected into the main steam system of the turbine and must follow the same path followed by the steam during normal operation. Injection points would have to be made and located in the main steam loops that feed the steam to the turbine's governing valve system. To incorporate these injection points, it was necessary to penetrate the main steam lines followed by certain machining steps in order to install a connection. This method had an initial estimated installation cost of $50,000. Thereafter the connection would require welding, x-ray testing, and stress-relieving measures prior to using the connection. Also, in some instances the structural integrity of the pressure vessel may have been altered and that would have to be repaired.

After cleaning had been completed, a cap would then have to be installed covering the connection and this required the additional welding and structural integrity retesting procedures to confirm the pressure load characteristic prior to placing the turbine back into operation. These connections are very expensive to install and future washes would still require time to remove the cap for cleaning and the subsequent reinstallation of the cap following completion of cleaning. Future use of this cleaning method including preparing for wash and restoring the turbine afterwards would cost at least $6000 every time used. Lost generation in to a 24 hour period would cost the power company at least $174,960 in replacement power costs.

SUMMARY OF THE INVENTION

In order to overcome the problems discussed above, it would be advantageous to find a quicker, more cost effective method of cleaning HP turbines and to easily inject chemical cleaning agents. The present invention provides an apparatus which can be substituted for one of the governor valves on a turbine steam chest to accomplish this objective.

This invention eliminates welding and the need to cut into the high pressure steam lines or pressure vessels. This invention constitutes a major advance since it permits the saving of time and money and also eliminates the need to x-ray the high pressure vessel. The initial installation costs are low as are future wash and restoration costs.

Preferably, the apparatus is attached directly to the steam chest and includes an aperture through which the chemical cleaning agent can be injected, as well as a mechanism to regulate the flow of the agent.

The cleaning process by which the deposits are removed from the turbine comprises removing an existing governor valve and replacing it with the present invention. The turbine is then prewarmed with auxiliary steam to enhance the chemical reaction, followed by the injection of the appropriate cleansing agents, for example a foam comprised of Ammonium Bicarbonate 16% and Ammonium Hydroxide 6%. The cleaning agents are injected directly into the steam chest and from there to each governor valve and nozzle block quarter while the turbine is turning thereby establishing more surface contact and, consequently, better foam contact. A benefit of injecting the chemical through the steam chest is that the chemical can contact the most upstream sections of the steam path and can contact regions of chemical deposits upstream of the turbine rotor. After cleaning, the spent solvent is returned to liquid form by use of an antifoam agent and is removed through the cold reheat section for chemical treatment and proper disposal. It is not unusual to perform material sampling to determine the effectiveness of the cleaning. After removing the chemicals, the system is rinsed to neutralize the effects of the cleaning agents and to prevent any subsequent chemical attack on the steam path materials. A typical rinse cycle would first use steam for 45 minutes to volatilize any trapped ammonia and then run purified or clean water will be run through the system for approximately 18 hours or until the conductivity is below 5 Mhos.

Other objects, features, and characteristics of the present invention, as well as methods and operation and functions of the related elements of the structure, and to the combination of parts and economies of manufacture, will become evident upon consideration of the following description and the appended claims with reference to the accompanying drawings wherein like reference numerals designate corresponding parts in the various figures, all of which form a part of this specification.

BRIEF DESCRIPTION OF THE DRAWINGS

The benefits of this invention can be better understood by using the drawings in conjunction with the following detailed description of the preferred exemplary embodiment of the present invention.

DETAILED DESCRIPTION OF THE PRESENTLY PREFERRED EXEMPLARY EMBODIMENT

Figure 1:
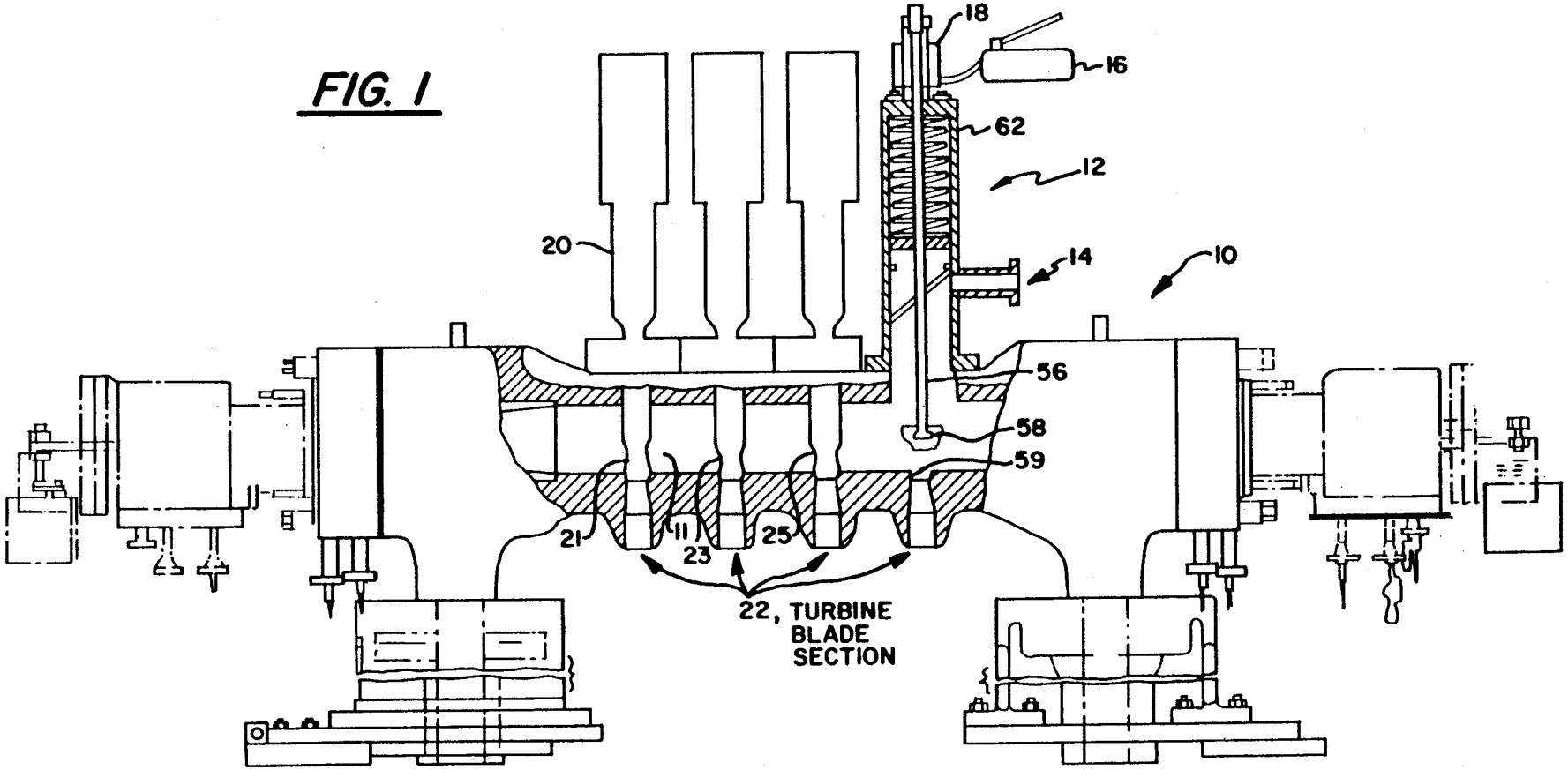
FIG. 1 is a partial cross-section of a turbine steam chest with the cleaning apparatus of the present invention replacing a governor valve.

Referring to FIG. 1, the apparatus according to the present invention for providing the connection to the turbine for cleaning is generally shown at 12, and is shown attached a turbine steam chest, generally indicated at 10. The turbine cleaning assembly 12, shown in an open or raised condition, replaces a conventional governor valve mechanism such as those shown at 20. The governor valve 20 that has been removed and replaced by the cleaning assembly 13, will be replaced after completion of the cleaning process and its removal is only temporary. The turbine cleaning assembly 12 can be interchanged with an existing governor valve mechanism 20 and without any modifications to the steam chest of the turbine since the connections are identical. The present invention has been designed to fit in the space vacated by a governor valve mechanism 20, to provide an open and closed position for the governor valve loop, and to allow chemical foam or warming steam to enter through the valve assembly. While the drawing depicts the turbine cleaning assembly 12 attached in place of the most forward governor valve, this is not always the case and it should be understood that the assembly 12 could replace any other governor valve.

Figure 2:
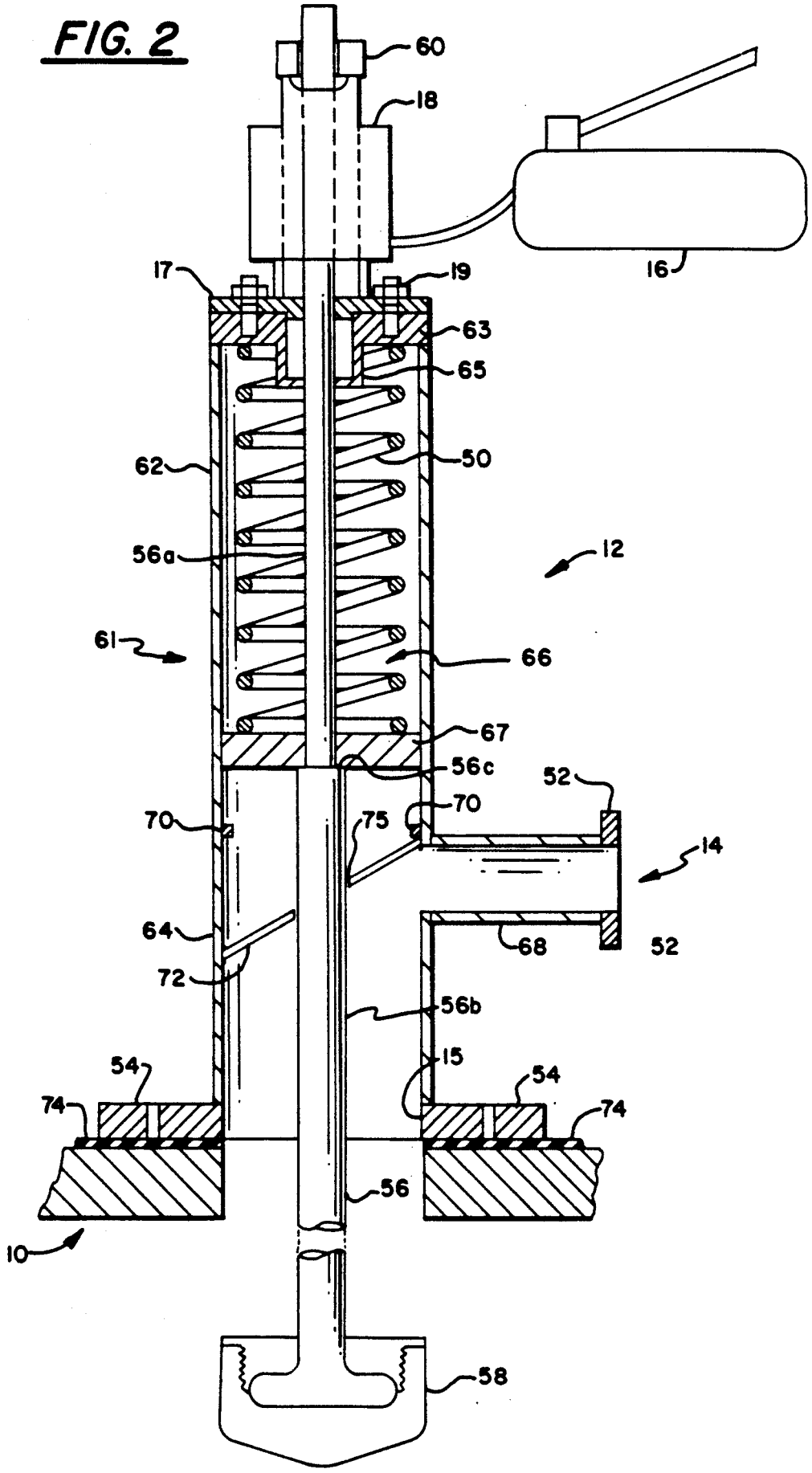
FIG. 2 is a diagrammatic cross-section of the injection apparatus shown in FIG. 1.

Referring to FIG. 2, the cleaning assembly 12 includes a cylindrical outer housing 61 having an open lower end, shown at 15. The assembly is attached to the steam chest 10 through use of a mounting flange 54 which extends around the periphery of the lower end and at the base of the lower housing section 64. Attachment is accomplished through the use of suitable bolts or studs (not shown) or any other conventional approach used for attaching governor values to steam chests. Mounting flange 54 extends radially outward from the lower section of the housing 64. When the cleaning assembly 12 is attached to the turbine a seal 74 made of conventional gasket material, such as rubber or silicone material, rests between the flange 54 and the steam chest 10. The flange is constructed of material such as a standard class 300 bolted flange having four bolt holes for receiving ⅝ inch bolts therethrough.

The cleaning apparatus 12 includes a housing, generally shown at 61, itself comprised of upper and lower portions as shown at 62 and 64, respectively. A piston assembly, generally indicated at 66, is reciprocally mounted within housing 61 so that it can be raised and lowered to thereby control the opening and closing of the valve in the cleaning system. Housing 61 includes an upper end wall 63, preferably welded to housing 61, and jack assembly 18 is bolted to wall 63 by bolts (not shown) and a mounting plate 17. End wall 63 includes a centrally positioned well 65 to permit suitable packing and sealing to surround stem 56 and against the interior of which is positioned a spring retaining plate 78. The well 65 also serves as an air seal, supplied with pressurized air via conduit 76, which expands the seal about stem 56 to prevent any chemicals from releasing to atmosphere. Referring to FIG. 2 the piston assembly 66 is comprised of a compression spring 50 with one end in contact with end wall 63 and with a drive piston 67 suitably fixed to stem 56, such as, for example, by a set screw (not shown).

As shown in FIG. 2, stem 56 can have a first diameter in its upper portion, 56*a*, and a second layer diameter in the lower portion 56*b with a shoulder 56c* defined at the juncture. Piston 67 can rest on shoulder 56*c*.

Plug 58 is fixed to the bottom end of the stem 56 by any suitable means, including by welding, adhesives, or removably fixed by threaded connection or by use of one or more set screws.

The upper end of stem 56 is operatively engaged with the jack assembly 18 so that the stem can be raised against the force of spring 50 by the action of jack assembly 18.

The compression spring 50, which operates between plate 78 and drive piston 67, is capable of exerting a sufficient force to keep the cleaning stem plug 58 in a normally closed condition. This will effectively stop the chemical foam or other cleaning material from entering the turbine through that opening except when desired and the piston assembly is raised.

Attached to the exterior of the upper section of housing 62 is a hydraulic pump 16 and jack assembly 18. The piston assembly 66 can be opened by a variety of devices or manually. One such device is the jack assembly 18 which is connected to a hard pump 16 to force an operating fluid into jack 18 to raise stem 56. A number of conventional hydraulic jacks exist and further description thereof is not deemed to be essential for a full and complete description of the invention. Alternatively, the raising of stem 56 could be accomplished by a screw jack, operatively connected to stem 56. The raising could be initiated manually or automatically by remotely controlled motors or other raising and powering mechanisms (not shown) that could be rendered operational in response to one or more signals, including a simple switch, generated by operating parameters of the turbine system.

The cleaning process requires operators to manually open and close the governor valves and apparatus, preferably in a desired sequential manner or rotation. When each governor valve 20 or piston assembly 66 are moved to open the steam chest aperture, as is indicated in FIG. 1 at 59, the chemical foam is allowed to flow through the outlet aperture 59 and then flow on into the turbine. To stop the flow to the turbine, the pressure is released from the hydraulic pump 16 and spring 50 will move the piston assembly 66 into its normally closed position, closing the steam chest outlet aperture as shown, for example, at 59. Movement of the piston assembly 66 is controlled in its downward movement by stops 70 which project radially inwardly from the interior wall of the upper section of housing 62. At least two diametrically opposed stops 70 are used but a greater plurality could be used. When the cleaning stem 56 and plug 58 are lifted by the jack assembly 18 or pushed down by spring 50, the outlet 59 of steam chest 10 to the turbine is either opened or closed, respectively. The plug 58 is raised when the stem 56 lifts, caused by increasing the pressure within the jack assembly 18 via hydraulic pump 16 assembly. The increased pressure lifts stem 56 and control piston 67 thereby raising plug 58 and compressing spring 50. Releasing pressure from the jack assembly 18 and pump 16 allows the spring 50 to force piston 67 and stem 56 and plug 58 down, closing aperture outlet 59. Although in the present embodiment, the hydraulic pump 16 and jack assembly 18 are attached on the outside of the upper housing 62, they are not limited only to being located on the exterior. It is possible that they could be inside or positioned at another part of the upper housing 62 so long as they still controlled the raising of stem 56. The tension in the compression spring 50 is adjustable using the adjustment nut 60 to vary the length of stem in the upper housing and the position of piston 67.

For cleaning purposes, a cleaning medium such as, for example, a chemical foam enters the turbine through the turbine cleaning assembly 12 and steam chest 10. During injection, the chemical foam exits the inlet means 68 and flows into the lower housing section 64 as well as in steam chest cavity 11 as shown in FIG. 1. The turbine is preheated with steam at approximately 100 psig. The chemical is injected through a chemical injection aperture 14 which can either be threaded or of a bayonet type mount or whatever is compatible with the cleaning chemical supply. The cleaning material then travels along a short conduit inlet section 68 into the lower section of housing 64. In the preferred embodiment, the conduit inlet 68 is in the form of a cylinder opening into the side wall of the lower portion of housing 64. The exact point of attachment for inlet 68 is not critical so long as it is below the actuator assembly described below.

To assist and direct flow a baffle plate or turning vane 72, as shown in FIG. 2, can be positioned approximately opposite the interior of inlet pipe 68. Incoming material will strike baffle plate 72 and be directed downwardly toward the entrance into the steam chest 10 through the open end 15. Baffle plate 72 is preferably welded in place to the interior sidewalls of housing 61 with the higher side of its angled attitude being adjacent one of the stops 70. The angle is small enough from the horizontal as for the flow area of pipe 68 to be restricted. Also, plate 72 is provided with a centrally positioned aperture 75 through which stem 56 can pass through and reciprocate. The aperture 75 has a close tolerance so as to minimize leakage.

The cleaning medium is prepared from a dry chemical that has been mixed with water and stored in bulk prior to use. Before injecting the chemical into the turbine system, the chemical is pumped from the bulk supply to a heat exchanger where the chemical is heated to between 150° F. and 170° F. Outside the turbine, air and a foaming agent are added to the chemical to produce a foam solvent. The air is added from a 100 PSI source and is regulated by a valve (not shown). To ensure that the chemical would only enter the apparatus, the inlet means is supplied with a flange 52 for securing the turbine cleaning assembly to a means for the injection of chemicals (not pictured). The chemical foam is injected into the steam chest 10 at a rate of 18 GPM (gallons per minute). The chemical foam is at pressure of approximately 3–5 psig at the injection point 14. The foam is pressurized by a chemical pump which adds flow energy to the chemical before it is turned into a foam.

During the chemical cleaning process, flow through at least one steam chest opening 22 to the turbine blading is required. The chemical foam is free to flow through the cleaning apparatus 12 following the same flow path the steam normally takes through the governor valve outlets 22. The governor valve outlets 22 are opened individually by opening the outlets controlled by the governor valves 21, 23, 25 or by opening the outlet controlled by the invention 12. This method will insure proper chemical contact in the steam passages to the blading. The same method is used for prewarming the turbine with steam.

The method for cleaning chemical deposits from a steam turbine involves the following objectives: maintaining a proper thermal environment for the chemical reaction; providing the necessary piping connections for injection and removal; containing the chemical solvent; disposing of the spent solvent; and restoring the system for operation.

While the invention has been described in association with the preferred embodiment which is currently considered most practical, it is to be understood that the invention is not limited only to the disclosed embodiment. This disclosure is intended to cover various modifications and equivalent apparatus within the spirit and scope of the claims. For example, modifications could include using different equipment in place of the jack and hydraulic pump which would perform the same function. The entire cleaning system could replace a governor valve other than the most forward one. The chemical injection means could be located at a different position or could be built so as to have some kind of metering means attached. A different type of plug could be used for sealing the governor valve outlet 22. The above-described components could be constructed in different sizes than were previously described, causing the invention to be either larger or smaller in size. Therefore, all people possessing ordinary skill in the art are sure to understand that all such equivalent structures are to be included within the scope of the appended claims.

What is claimed is:

1. Cleaning material injection apparatus for use with the steam chest of a turbine and in particular in place of a governor valve of the steam chest for an aperture in the steam chest leading to the turbine, said injection apparatus comprising:

a housing assembly having an upper and lower portion, said lower portion including a hollow interior defined by side walls, said hollow interior terminating at means defining an open end wall;

a flange for attaching the apparatus to the turbine, said flange extending radially from said means defining said open end wall;

a piston assembly reciprocally mounted within said housing , said piston assembly including a valve stem having a plug member at one end thereof for closing the steam chest aperture leading to the turbine;

drive means for reciprocating said piston assembly between a first raised position where the steam chest aperture is open and a second lowered position where the steam chest aperture is closed; sliding seal means operatively connected with said piston assembly to seal the piston assembly to prevent release of cleaning materials to the atmosphere; and inlet means for providing an open passageway leading into said lower portion to permit the inlet of cleaning material into the injection apparatus, said inlet means including a baffle member to direct the flow of inlet material into the lower portion of the housing.

2. Apparatus as in claim 1 wherein said piston assembly further includes a hydraulic pump and jack assembly for reciprocating said valve stem.

3. Apparatus as in claim 1 wherein said plug member is dimensioned so that it will control the flow of material into said turbine through the steam chest when lifted as said stem is raised by said hydraulic pump and jack assembly.

4. Apparatus as in claim 1 wherein said piston assembly further includes a control piston fixed to said stem at a point spaced axially from said plug member and a compression spring operating between said housing and said control piston for forcing said piston assembly normally downwards so that when the assembly is attached to the steam chest, the aperture in the steam chest leading to the turbine is blocked.

5. Apparatus as in claim 1 wherein said piston assembly includes inwardly directed projections extending into said hollow interior to define a lower limit for the travel of said piston assembly so that said plug member will tightly block said aperture.

6. Apparatus as in claim 4 further comprising means for adjusting the tension of said compression spring.

7. A method for cleaning a turbine with cleaning material through the steam chest of a turbine where the steam chest includes a plurality of governor valves each of which separately controls one of a plurality of steam apertures leading to the interior of the turbine, said method including the steps of:

removing one of said plurality of governor valves, attaching to said steam chest apparatus comprised of a housing assembly having an upper and lower portion, said lower portion including a hollow interior defined by side walls, said hollow interior terminating at means defining an open end wall, a flange for attaching the apparatus to the turbine, said flange extending radially from said means defining said open end wall, a piston assembly reciprocally mounted within said housing, said piston assembly including a valve stem having a plug member at one end thereof for closing the steam chest aperture leading to the turbine, drive means for reciprocating said piston assembly between a first raised position where the steam chest aperture is open and a second lowered position where the steam chest aperture is closed, and a pipe extending outwardly from and providing an open passageway leading into said lower portion for use as an inlet for a cleaning material, said apparatus attached in the space left vacant by said governor valve;

prewarming the turbine with steam to enhance a chemical reaction involved with cleaning said turbine, pumping a chemical agent mixed with water from a bulk chemical supply to a foam generator where air and a foaming agent are added to a solution, of chemicals and water, admitting the resulting foam into the steam chest of said turbine through said apparatus and allowing said foam to enter said turbine through turbine governor valves while said turbine is on turning gear for better foam contact, returning the spent foam to a liquid by use of an antifoam agent, and removing the resulting liquid for chemical treatment and proper disposal; and replacing said apparatus with said original governor valve.

* * * * *